United States Patent [19]

Windsor, Jr.

[11] Patent Number: 4,751,840

[45] Date of Patent: Jun. 21, 1988

[54] ELECTRICIAN'S WIRE BENDING TOOL WITH MANDRELS

[76] Inventor: John F. Windsor, Jr., 4501 Raymar Dr., Orlando, Fla. 32809

[21] Appl. No.: 23,569

[22] Filed: Mar. 9, 1987

[51] Int. Cl.[4] ..... B21D 7/022

[52] U.S. Cl. ..... 72/478; 72/458; 7/107; 81/176.1; 81/177.85; 81/177.5; 81/124.3; 140/123

[58] Field of Search ..... 72/458, 459, 478, 479; 81/176.1, 176.15, 176.2, 177.85, 177.5, 124.3; 140/123, 106; 7/107, 117

[56] References Cited

U.S. PATENT DOCUMENTS

| | | | |
|---|---|---|---|
| 464,534 | 12/1891 | Tribbals . | |
| 548,420 | 10/1895 | Bauer . | |
| 1,382,109 | 6/1921 | Matsler | 140/123 |
| 1,805,797 | 5/1931 | Bates . | |
| 1,990,583 | 2/1935 | Dickinson . | |
| 2,195,773 | 4/1940 | Foshee . | |
| 2,571,241 | 10/1951 | Henderson | 72/458 |
| 2,968,980 | 1/1961 | Zierold | 81/177.5 |
| 3,174,517 | 3/1965 | Wilson . | |
| 3,709,264 | 1/1973 | Amman . | |
| 3,902,350 | 9/1975 | McManus | 72/479 |
| 4,227,429 | 10/1980 | Bowers, Jr. et al. | 81/176.15 |
| 4,423,757 | 1/1984 | Broberg, Jr. . | |
| 4,466,315 | 8/1984 | Boschetto, Jr. et al. | 81/177.85 |

FOREIGN PATENT DOCUMENTS

| | | | |
|---|---|---|---|
| 404437 | 1/1934 | United Kingdom | 81/177.5 |

OTHER PUBLICATIONS

H. Liner, Jr. and Springer, "Bending Tool for Looped Leads", Apr. 1971, p. 27.

*Primary Examiner*—David Jones
*Attorney, Agent, or Firm*—Julian C. Renfro

[57] ABSTRACT

An electrician's wire bending implement particularly adapted for use with a set of mandrels that are each provided with a drive socket, comprising in combination, an elongate basic wire bending tool, and a graduated array of mandrels that are each equipped with a pair of spaced apart pins. A square drive is provided at one end of the basic tool, and a handle is provided for use on the end of the basic tool remote from the square drive. The handle is to be used on the basic tool when ample torque is to be applied while making lateral bends in heavy gauge wire, using the spaced pins of a selected mandrel that has been mounted on the square drive. Preferably I use a fixed wire forming jaw on the end opposite the square drive, to facilitate creation of fore and aft bends in heavy gauge wire.

11 Claims, 3 Drawing Sheets

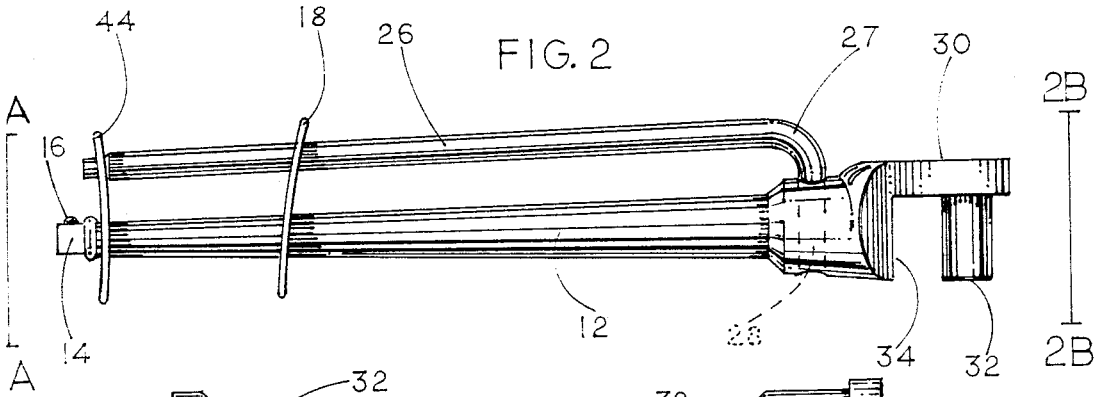
FIG. 2
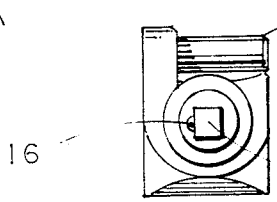
FIG. 2A
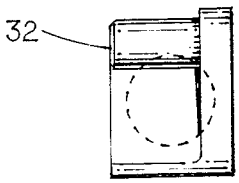
FIG. 2B
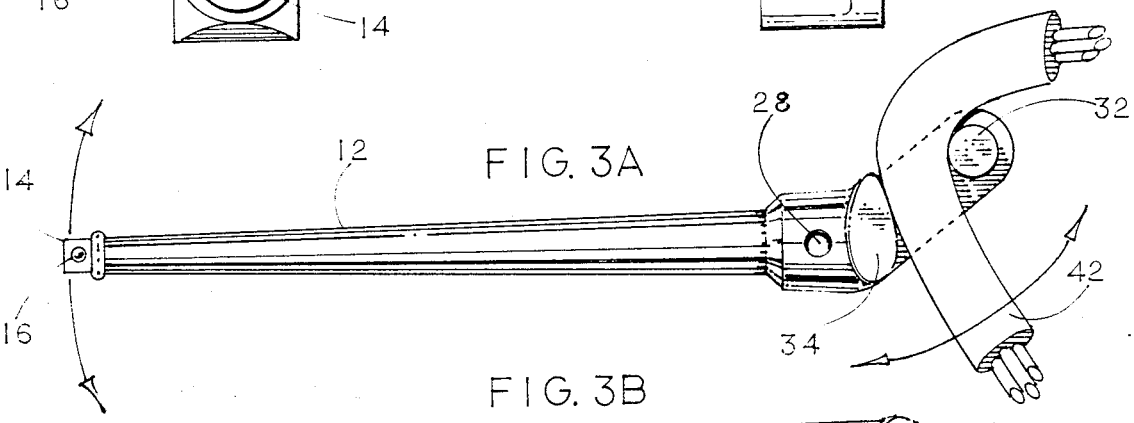
FIG. 3A
FIG. 3B
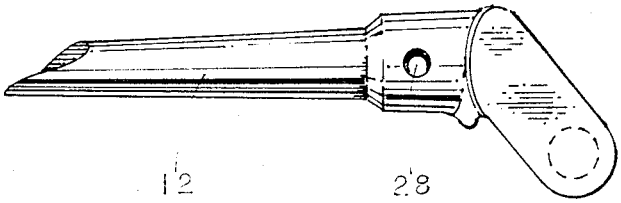
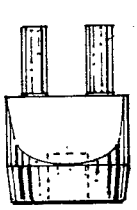
FIG. 4A
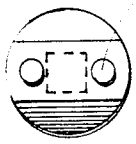
FIG. 4C
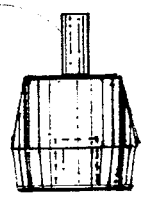
FIG. 4B
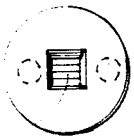
FIG. 4D

ELECTRICIAN'S WIRE BENDING TOOL WITH MANDRELS

BACKGROUND OF THE INVENTION

In electrical installations the current supply wires are often of fairly large diameter and heavily covered with insulation. This makes them stiff and hard to bend. In a typical installation, heavy duty, large gauge aluminum or copper wires are used to carry electrical current from a commercial power source through a service entrance head to an electric meter base and then on to a circuit breaker box, fuse box, buss junction box or other similar electrical wiring junction box or boxes. In each instance, the large gauge wire must be bent to acute angles in a very confined space in order to make a physical connection, and thus complete a desired circuit. Usually these wires are manually bent to the desired shape by the wiremen, and their bending is arduous and time consuming.

It is important to note that whereas heavy gauge wire in long lengths can often times be bent comparatively easily, short lengths of heavy gauge wire in a confined space are usually extremely difficult to bend, and many electricians confronted with the problem of making a short left hand or right hand bends will attempt to improvise the proper tool by using the jaws of electrician's pliars or some other makeshift tool. The disadvantage of this, however, is that the pliars and such will often tear or rip the insulation around the wire, thus making the use of an appropriately configured bending tool most desirable.

It was in an effort to provide a highly advantageous and versatile yet reasonably priced wire bending tool for an electrician that the present invention was evolved.

SUMMARY OF THE INVENTION

In accordance with this invention, I have provided a bending tool or wrench employable in two different modes, that is, I have provided a basic wire bending tool or wrench whose one end can be used with any of a comparatively large number of different mandrels of graduated size, such that a number of different sizes of insulated wires can be bent in a lateral, left or right sense. The other end of the wrench is equipped with a fixed wire forming jaw that can be effectively utilized when the electrician wishes to bend the insulated wire toward or away from his body, or, in other words, bend the wire in a to and fro direction.

Quite advantageously, the basic wire bending tool in accordance with my invention is preferably provided at its one end with a ½ inch square drive of the type common to automotive ratchet sets, which arrangement makes it readily possible for the electrician to select and quickly install a selected size of wire bending mandrel in accordance with this invention, such that a short length of insulated wire being dealt with in a confined space can be bent in a lateral manner so as to be insertable into a circuit breaker, buss bar, special fitting, connector, or the like.

The fixed wire forming jaw utilized on the other end of the wrench is of a configuration chosen to be usable with a wide variety of wire sizes, and this jaw in most instances need not be of adjustable size. I prefer for it to be angled, for reasons of increased versatility.

This invention lends itself to being packaged in a relatively small box or container, with provision being made for conveniently mounting the six or so mandrels of graduated size, so that at a glance the electrician can select the appropriate mandrel for the particular situation with which he is confronted. By having the end of each mandrel away from its wire engaging portion provided with a square drive hole or socket of the appropriate size, the selected mandrel can be quickly installed on the square drive of the basic wire bending tool, and then immediately used for engaging and bending the short lengths of wires residing in a confined space, such as in a circuit breaker box.

Useful items in addition to the mandrels of graduated size can be provided with square drives, so that the electrician can be enabled to apply sufficient torque to such items as Allen wrenches or screwdriver blades by the use of the basic wire bending tool provided in accordance with this invention.

In order to provide the electrician with an ample amount of torque, so that he can effectively use the selected mandrel, Allen wrench tip, screwdriver tip, or the like, I prefer to provide a hole in the basic wire bending tool, at the end remote from the square drive, in which hole a simple T-handle can be readily mounted. I prefer to construct the T-handle of metal of sufficient diameter that it can withstand relatively high rotational moments without bending or failing. Because the T-handle can thereafter be quickly removed after use, the storage container for my novel wire bending tool can be of relatively small size inasmuch as the T-handle can be readily stored alongside the basic wire bending tool.

Although I have found that in the most usual circumstance, the electrician will be principally concerned with making lateral bends in the wire in order to make the appropriate connections, and hence will be utilizing a mandrel of the most appropriate size, there are definite instances in which the electrician will need to be making a bend ninety degrees to the lateral, or in other words, he will need to bend the wire either toward or away from his body. In such an instance, even a properly sized mandrel is not particularly effective in bending heavy gauge wire in this manner, so I therefore provide on the opposite end of the basic wire bending tool, the fixed wire forming jaw that is particularly adapted for engaging and then making non-lateral bends in the heavy insulated wire.

Whereas in the case of the use of mandrels it is desirable to be able to insert a T-handle so that a desirable amount of torque can be developed, when the electrician is using the end of the basic wire bending tool containing the fixed wire forming jaw, no use of an additional handle type member is necessitated, for in using such fixed jaw, the basic wire bending tool itself inherently defines a relationship in which the electrician can easily develop considerable torque.

In the interests of maximum service life, strength and utility, I envision that all component metal parts of this invention i.e., the basic tool, mandrels, and T-handle, will be constructed of high integrity materials, such as drop forged or heat treated steel, or hardened chrome vanadium or nickel chrome tool steel, or the equivalent.

It is therefore to be seen that a principal object of my invention is to provide an electrician's wire bending tool capable of effective use in any of a wide variety of confined spaces.

It is another object of my invention to provide a handy wrench of low cost that enables relatively short lengths of heavy gauge wire to be bent within the confines of an electrical circuit box.

It is still another object of my invention to provide an electrician's tool of highly effective design usable with a variety of differently sized mandrels.

It is yet still another object of my invention to provide a multiuse handle with a square drive on one end that not only is readily usable with differently sized wire bending mandrels, but also which may be used with an Allen wrench or the like mounted upon a square drive, thus to make it possible for the electrician also to be able to use my novel basic wrench or tool for loosening or tightening set screws in circuit breaker buss bars or electric meter bases.

It is yet still another object of my invention to provide a uniquely effective wire bending tool for an electrician that can be stored in a small box or container, despite the fact that my tool is effective for a wide range of wire sizes and for a multiplicity of purposes.

Yet another object of this invention is to provide a graduated array of mandrels each of which can be utilized in concert with the basic wire bending tool as a complete "set" or, can be purchased separately as a set of mandrels in the same manner in which a set of automotive sockets can be purchased, with such set of mandrels completely usable and compatible with any standard square drive automotive ratchet wrench or flex handle at a greatly reduced purchase price.

BRIEF DESCRIPTION OF DRAWINGS

FIG. 2 illustrates my wire bending tool, with a handle of the type preferred for use with a novel wire bending tool being shown in stored relationship alongside the tool;

FIG. 2A is a view of the left end of the device shown in FIG. 2, as rotated 90°;

FIG. 2B is a view of the right end of the device shown in FIG. 2, as rotated 90°;

FIG. 3A is a view of my basic wire bending tool showing how the end remote from the square drive for mandrel insertion may be used for bending a heavy piece of insulated stranded cable toward or away from the operator;

FIG. 3B is a view similar to FIG. 3A, but showing the basic tool rotated so as to reveal the opposite side of the basic tool;

FIG. 4A is a side elevational view of a typical mandrel;

FIG. 4B is an end view of the same mandrel shown in FIG. 4A;

FIG. 4C is a top view of the same mandrel;

FIG. 4D is a bottom view of the mandrel, revealing the placement of a hole to receive the square drive tip of the basic tool;

DETAILED DESCRIPTION

Figure 1:
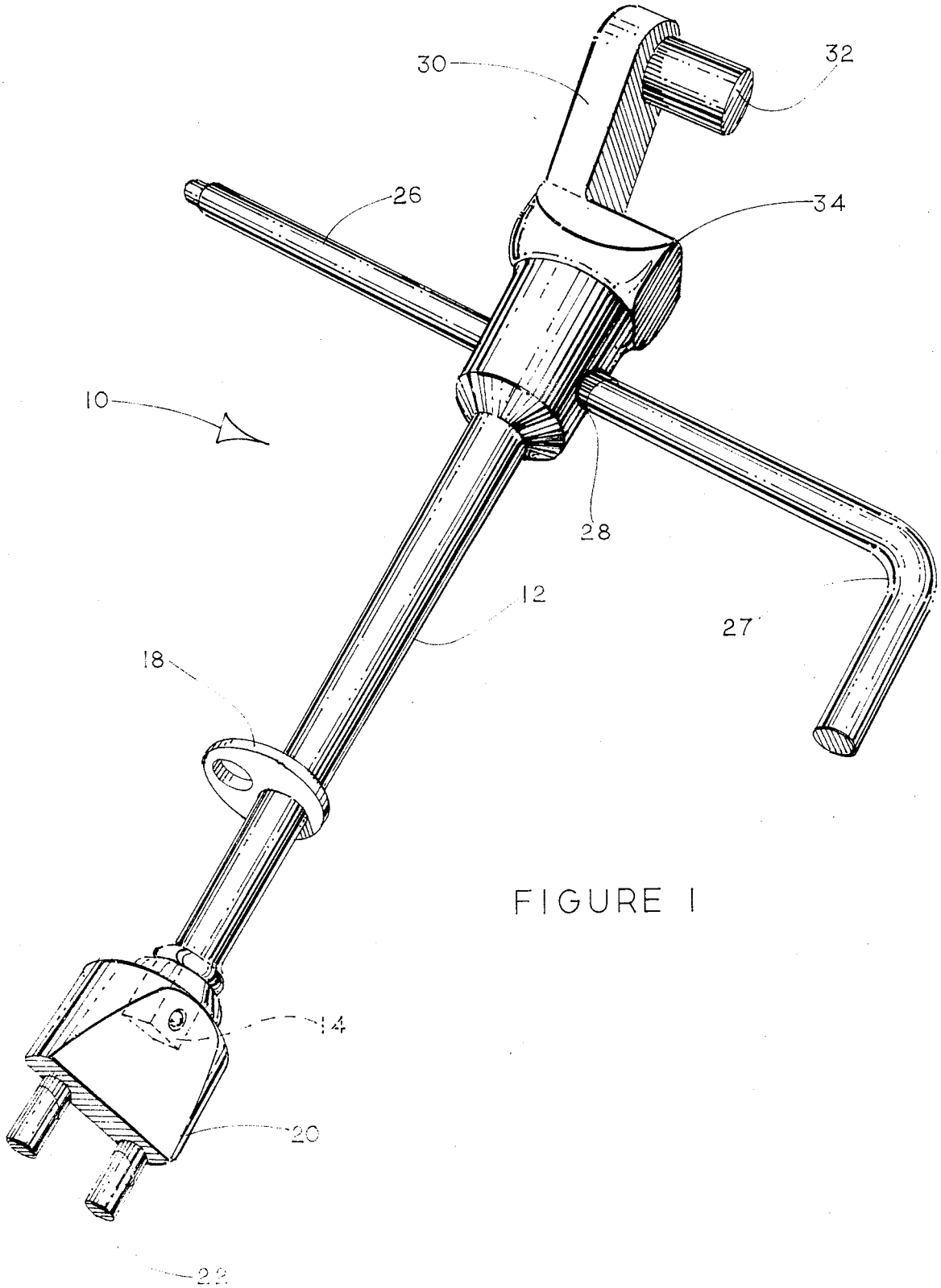
FIG. 1 is a perspective view showing a preferred embodiment of my basic wire bending tool, on one end of which is mounted a typical mandrel, which is insertable upon a square drive formed at the end of the basic wire bending tool.

Turning to FIG. 1, it will there be seen that I have depicted a preferred embodiment of an electrician's wire bending implement 10 in accordance with this invention, principally involving an elongate basic wire bending tool 12, on one end of which is created a square drive 14, with this square drive being in the nature of the square drive used on the handle of a conventional socket wrench set.

A mandrel 20 is shown operatively mounted upon one end of the basic wire bending tool 12, with the mandrel being equipped with a spaced pair of protruding pins 22 at one end. As can best be seen from FIG. 4D, each mandrel used with my tool has a square socket or recess 24 on the end opposite from the spaced pins 22, with this socket or recess 24 being of a configuration to fit properly upon the square drive 14 of the basic wire bending tool. The pair of pins 22 are spaced so as to be able to engage insulated wire of a certain size, and then enable the electrician to laterally bend the wire in the desired manner. I prefer to use a ball detent 16 on the square drive, so as to cause the selected mandrel to be held on securely, without the danger of it falling off during use by the electrician.

It will be noted from FIG. 1 as well as FIG. 2 that I may use a handle retaining member 18 on the basic tool 12, so that the handle 26 may be removably secured to the basic tool at the time my implement is to be stored. Note FIG. 2.

On the end of the basic wire bending tool 12 remote from the square drive 14 is a fixed wire forming jaw 30 which, as will be explained hereinafter, is utilized for bending heavy electrical wire toward the user or away from the user, which is in contrast with the mode in which the mandrels are used, for the mandrels are used in making lateral bends in the wire—that is, a bend to the left or a bend to the right. A large pin 32 is an integral part of the fixed wire forming jaw 30, as is the abutment 34 located a spaced distance from the large pin 32.

Whereas in the use of the fixed wire forming jaw 30, the basic tool member inherently provides the user with an ample amount of torque, when a mandrel 20 of selected size is inserted upon the square drive 14, the resulting configuration is one in which the average user could not develop a sufficient amount of torque to bend a heavy gauge wire. Accordingly, I provide on the end of the basic tool member opposite the square drive 14, a hole 28, best seen in FIGS. 3A and 3B, in which a handle 26 of the type shown in FIGS. 1 and 2 may be inserted at the time my tool is to be used.

Since my electrician's wire bending tool was designed for packaging in a small space, I prefer a design utilizing an inserted handle over a design in which the handle is hingedly mounted on the basic tool member. A handle of the type shown at 26 in FIGS. 1 and 2, which may be known as a T-handle, which preferably has a 90° bend 27 at one end is preferred for use.

There need be no particular relationship between the fixed wire forming jaw 30, and the hole 28, and the spacing between the jaw and the hole need not be fixed at any particular dimension.

It is to be realized that the mandrel 20 shown in FIG. 1 mounted upon the tool member 12 is only one of a number of different mandrels provided in order that the electrician can select a mandrel of the size appropriate for bending a certain selected heavy gauge wire.

Figure 6:
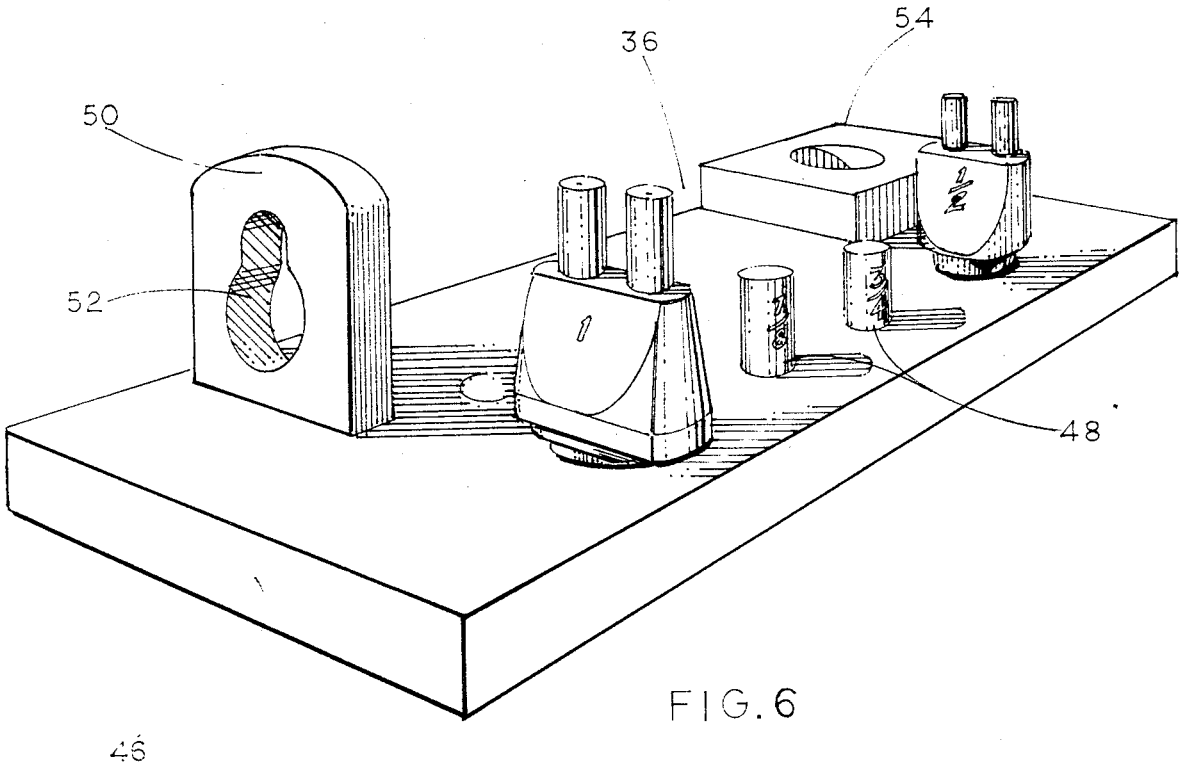
FIG. 6 is a perspective view of a graduated array of mandrels on a mounting base, each of which mandrels is usable with the basic wire bending tool.

A graduated array 36 of typical mandrels 20 is shown on a mounting base 46 in FIG. 6, and it is to be realized that on one end of each mandrel, the aforementioned square hole or recess is provided, such that the square drive 14 on the basic wire bending tool 12 can be readily used with any mandrel the electrician has selected. As previously mentioned, on the other end of each mandrel, that is, opposite the socket or recess 24, there is the pair of protruding pins 22, with the spacing between the pins for each mandrel being different than the spacing between the pins of any other mandrel of the graduated array.

By way of example, six mandrels of graduated size may be provided on the mounting base 46, with the spacing between the pins being as follows:

$\frac{3}{8}$ inch; $\frac{1}{2}$ inch; $\frac{5}{8}$ inch; $\frac{3}{4}$ inch; $\frac{7}{8}$ inch; and 1 inch. Spacing to be generally expressed in inches (or fractions thereof) rather than wire gauge due to the varying thickness of different types of wire insulation.

For reasons of space and preservation of perspective, the mounting base 46 in FIG. 6 is shown to have provisions only for four mandrels, but it is to be understood that I prefer for the mounting base to accommodate six mandrels, of sizes preferably as set forth above.

Therefore, it is expected in the use of my tool that the electrician will select the mandrel of a size appropriate for the particular insulated wire to be laterally bent. After the mandrel of the appropriate size has been installed on the square drive 14, the electrician then will need to insert the T-handle 26 into the hole 28, so that he can develop a sufficient amount of torque to be able to bend heavy gauge electrical wire in the desired lateral direction, that is, either to the left or to the right. Such a bending effort in a constricted space is typically quite difficult, but by the use of my novel wire bending tool, such bending is quite easy to bring about.

Figure 5:
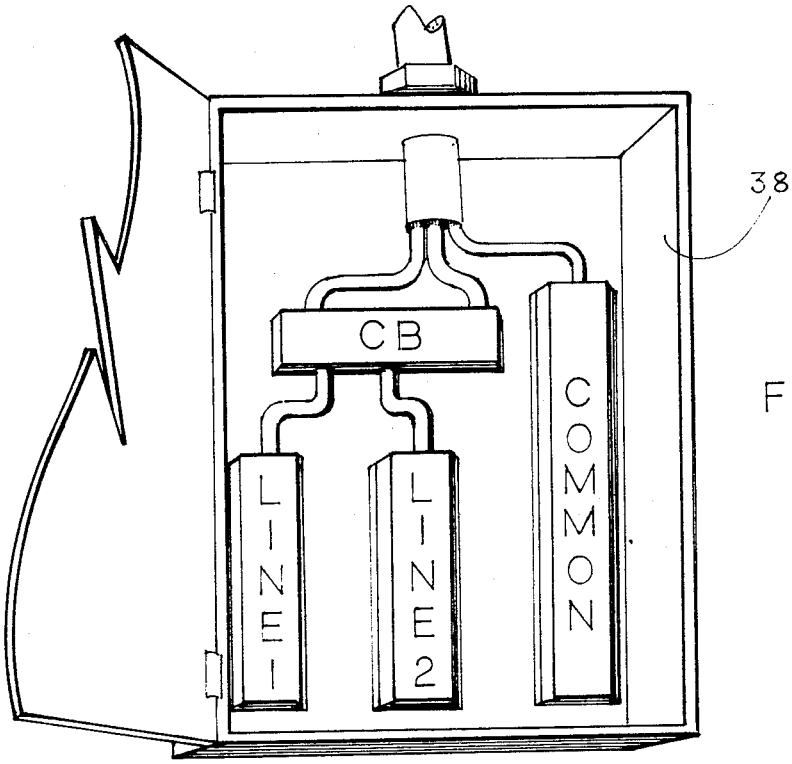
FIG. 5 is a view of a typical electrical box, with this view being provided in order to show the type of bends to be formed in heavy electrical wire by the selective use of my novel array of graduated mandrels.

In FIG. 5 I illustrate a typical electrical box 38, of a type well known to those skilled in this art, with several lateral bends in the heavy gauge electrical wires being depicted. Although nothing shown in this figure represents a part of my invention, it nevertheless should be mentioned that in FIG. 5 I show a typical 220 volt residential circuit breaker box, this being included so as to depict several lateral bends in the heavy gauge electrical wires entering the box. Because of the confined space in such a box, it is very difficult, utilizing conventional tools, for an electrician to make 90° bends required in the heavy gauge wire in order for them to be connected to the components in the box. By the use of my novel basic wire bending tool 12 and a mandrel whose pins 22 are the appropriate distance apart, however, creating the desired bends at appropriate locations in the heavy gauge wire is not difficult, and quite importantly, the insulation on such wires is not damaged.

In the illustrated instance, line 1 is a first 110 volt circuit, and line 2 is a second 110 volt circuit, with the common buss being regarded as the third wire or ground circuit. Component CB is a typical master circuit breaker, usually of 100 amperes or greater.

Returning to a previously discussed part of my invnetion, I have found that even though the proper size mandrel has been selected and inserted on the square drive 14, it is difficult to bring about a proper bend in heavy gauge electrical wire in the event the wire is to be bent either toward or away from the electrician. To that end, I have provided on the basic tool 12 opposite the square drive 14, the previously-mentioned fixed wire forming jaw 30. By virtue of the use of the pin 32 and the abutment 34 of the jaw, the electrician, after using the mandrel, need only turn the basic wire bending tool end for end in order to be able to readily use the tool for bending the heavy wire toward or away from himself.

As will be seen from FIG. 3A, when it is desired to bend a piece of heavy gauge wire 42, the electrician utilizes the fixed wire forming jaw 30 by causing the large pin 32 to reside on one side of the wire 42, and the abutment 34 on the other side of the wire. Such being accomplished, the electrician, by moving the remote end of the basic tool 12 downwardly, can cause the abutment-pin relationship to bring about a bend in the illustrated wire to the desired extent.

After completing a bend of this latter type by the use of the jaw 30, the electrician then again turns the tool end for end, so that by the selection of a mandrel having its pins 22 spaced in the most appropriate manner, he can complete the lateral bends necessary for him to be able to insert the stripped end of the wire into the circuit breaker, the buss bar, or the like.

As is obvious, it may be useful to utilize my basic wire bending tool in tightening the fitting utilized on the circuit breaker or the buss bar for holding the wire to such member, with such fitting typically being tightened by the use of an Allen head set screw. Accordingly, in addition to the set of mandrel of graduated size, I may include an Allen wrench mounted for use with a square drive. Furthermore, with the mandrel set I may also elect to have a flat head screw driver tip as well as a Phillips head screw driver tip, with each of these also being equipped with a square drive.

As to the configuration of the T-handle, the handle 26 preferably has the aforementioned curved end 27, as shown in FIGS. 1 and 2, so as to form a handle with a long portion and a short portion. Therefore, when it is desired to store the handle and basic wire bending tool, the short portion of the handle can be inserted into the hole 28, and these two principal components then nested together; note FIG. 2.

To prevent dislodgment of the handle from the tool when in the nested position, I may use a type of small, gasket-like member 18 as the handle retaining member, which is to be seen in FIGS. 1 and 2. The member 18 may be of rubber, plastic, or the like, and such member is equipped with a pair of holes, one of which is visible in FIG. 1, which enable the member to be inserted simultaneously over the ends of the tool and the handle, as shown in FIG. 2. As is obvious, the electrician may wish to remove the member 18 at the time he is actively using the tool.

As will be noted from FIG. 2, I may also utilize a second handle retaining member 44 near the square drive 14, so as to aid in the securing of the handle 26 in the stowed position. If desired, the end of the handle 26 remote from the bent portion 27 may be turned or formed to have a diminished diameter, such that the second retaining member 44 can be inserted tightly thereupon.

Returning to FIG. 6, I have shown the mounting base 46 equipped with a plurality of pegs 48, each of a diameter such that a mandrel may be inserted thereon at the time of storage. As is obvious, the pegs 48 are closer together at the end where the mandrels are small, and further apart for the large mandrels, so that the mandrels may be readily disposed in a graduated array on the base 46.

Also disposed on the mounting base is an upstanding member 50, in which is located an oblong hole 52 of a size and configuration such that the square drive end of the tool 12 can be inserted, while the handle 26 is in the stowed position thereon.

On the mounting base 46 remote from the upstanding member 50 is a receptacle 54 designed to receive the large pin 32 of the fixed jaw portion 30 of the basic tool 12. No particular configuration of the receptacle 54 is necessary, and it may take the form of a hole extending downwardly into the base member 46.

Obviously I am not to be limited to any particular form of storage device for my implement 10, and any other suitable form of a mounting arrangement or storage arrangement different from the mounting base 46 may be utilized if desired, such as a small tool box or the like.

Also it is to be realized that I am not limited to the use of a square drive 14 on the end of the basic wire bending tool 12. Although it is advantageous to use a square recess or socket in the end of each mandrel, so that my novel mandrels can be used with existing socket wrenches of the type used by mechanics and the like, it may be desirable to use an unusual configuration, involving for example a five sided or seven sided drive 14 on the tool 12, with the sockets to be used with such tool likewise having five sided or seven sided recesses, thus forcing a purchaser of graduated mandrels in accordance with my invention to also purchase a new tool in the nature of tool 12.

I claim:

1. An electrician's wire bending implement for use with a set of various size mandrels that each have a pair of spaced apart pins, with each of said mandrels being provided with a drive socket, comprising in combination, an elongate wire bending tool having drive means formed at one end and bending means at the other end thereof, and a mandrel selected from said set of mandrels for mounting at the one end, a hole provided adjacent said other end of said elongate tool, and a handle provided for insertion into said hole to provide considerable torque while bending a heavy wire, said selected mandrel being removably mounted on said drive means by the use of its drive socket, said handle being generally of L-shape, with a long portion and a short portion, said short portion being insertable into the hole located adjacent said other end of said elongate tool, at the time the handle and the elongate tool are to be nested together for storage.

2. The electrician's wire bending implement as recited in claim 1 in which each mandrel of the set is provided with a pair of pins spaced apart a distance different from the spacing between the pins of any other mandrel of the various sized set, with such pair of pins in each instance being disposed opposite the drive socket of the mandrel.

3. The electrician's wire bending implement as recited in claim 1 in which a component of deformable material is provided on said tool for securing said handle and said tool together at the time they are to be nested for storage.

4. An electrician's wire bending implement for use with a set of mandrels of graduated size that each have a pair of spaced apart pins, with each of said mandrels being provided with a square drive socket, comprising in combination, an elongate wire bending tool having a square drive at one end and bending means at the other end thereof, and a mandrel selected from said set of graduated mandrels for mounting upon said one end, a hole formed adjacent said other end of said elongate tool, remote from said square drive, a handle removably insertable into said hole to provide sufficient torque while bending a heavy wire, said selected mandrel being mounted on said square drive end by the use of its square drive socket, said handle being generally of L-shape, with a long portion and a short portion, said short portion being insertable into said hole in said elongate tool at the time the handle and the elongate tool are to be nested together for storage.

5. The electrician's wire bending implement as recited in claim 4 in which each mandrel of the set is provided with a pair of pins spaced apart a distance different from the spacing between the pins of any other mandrel of the graduated set, with such pair of pins in each instance being disposed opposite the square drive socket of the mandrel.

6. The electrician's wire bending implement as recited in claim 4 in which a component of deformable material is provided for securing said handle and said tool together at the time they are to be nested for storage.

7. An electrician's wire bending implement for use with a set of mandrels of graduated size that are each provided with a square drive socket, comprising in combination, an elongate wire bending tool having a square drive formed at one end of said tool, and bending means at the other end thereof, with said bending means comprising a fixed jaw, a hole formed adjacent the end of said tool remote from said square drive, a handle removably insertable into said hole to provide sufficient torque while bending a heavy insulated wire, and a selected mandrel of said set of mandrels mounted on said square drive end by use of its square drive socket.

8. The electrician's wire bending implement as recited in claim 7 in which each mandrel of the set is provided with a pair of spaced apart pins, disposed opposite its square drive socket.

9. The electrician's wire bending implement as recited in claim 7 in which said handle contains a component enabling it to be nested with said wire bending tool when the tool is to be stored or carried.

10. The electrician's wire bending implement as recited in claim 7 in which said handle is generally of L-shape, with a long portion and a short portion, said short portion being insertable into said hole in said tool at the time the handle and the tool are to be nested together for storage.

11. The electrician's wire bending implement as recited in claim 10 in which a component of deformable material is provided on said tool for removably securing said handle and said tool together at the time they are to be nested for storage.

* * * * *